United States Patent [19]

Stahlecker

[11] Patent Number: 4,866,924

[45] Date of Patent: Sep. 19, 1989

[54] TWO-COMPONENT YARN

[75] Inventor: Fritz Stahlecker, Bad Ueberkingen, Fed. Rep. of Germany

[73] Assignee: Hans Stahlecker, Fed. Rep. of Germany

[21] Appl. No.: 202,546

[22] Filed: Jun. 6, 1988

[30] Foreign Application Priority Data

Jun. 10, 1987 [DE] Fed. Rep. of Germany ..... 3719280

[51] Int. Cl.[4] ..... D01H 5/28; D01H 7/00; D02G 3/38

[52] U.S. Cl. ..... 57/243; 57/6; 57/328

[58] Field of Search ..... 57/205, 210, 227, 228, 57/236, 238, 243–245, 328–331, 293, 294, 297, 3, 6

[56] References Cited

U.S. PATENT DOCUMENTS

| | | | |
|---|---|---|---|
| 3,822,543 | 7/1974 | Edagawa et al. | 57/328 |
| 4,069,656 | 1/1978 | Arai . | |
| 4,084,400 | 4/1978 | Movshvich et al. | 57/293 |
| 4,450,675 | 5/1984 | Petrov | 57/328 X |
| 4,484,436 | 11/1984 | Nakayama et al. | 57/328 |
| 4,495,761 | 1/1985 | Nakayama et al. | 57/328 |
| 4,574,579 | 3/1986 | Chao | 57/328 |
| 4,596,115 | 6/1986 | Maeda | 57/289 |
| 4,761,946 | 8/1988 | Stahlecker | 57/328 |

*Primary Examiner*—Donald Watkins
*Attorney, Agent, or Firm*—Barnes & Thornburg

[57] ABSTRACT

A two-component yarn is created from a fiber component and a component consisting of a filament yarn, in which the fiber component is formed by a drawn sliver that is prestrengthened by means of pneumatic false-twist spinning and is twisted together with the filament yarn.

6 Claims, 1 Drawing Sheet

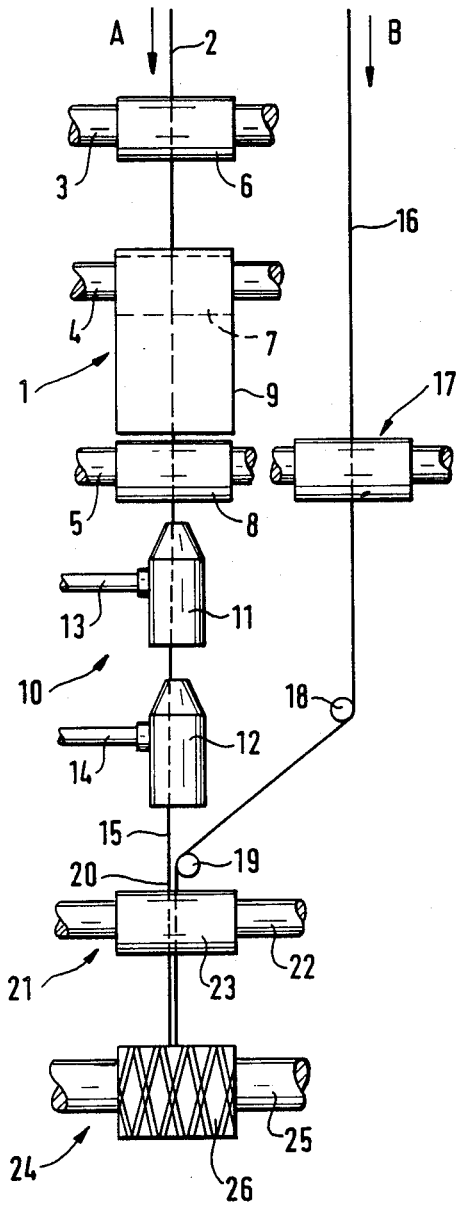
A
2
B
3
6
16
4
7
1
9
17
5
8
13
11
10
18
12
14
15
19
20
21
23
22
24
25
26

TWO-COMPONENT YARN

BACKGROUND AND SUMMARY OF THE INVENTION

The invention relates to a two-component yarn, having a a fiber component and a component consisting of a filament yarn, and to a process for its production.

It is known (U.S. Pat. No. 4,069,656) to produce a two-component yarn from a fiber component and a filament yarn. The fiber component passes through a drafting frame, and then, together with the filament yarn, through a pneumatic false-twisting nozzle, whereby the filament yarn is combined with the fiber component. This results in a two-component yarn with an alternating twist that cannot be used universally; for example, it cannot be used as a sewing thread.

In the case of sewing threads, a high resistance to tearing and a high uniformity are required. Known sewing threads made of filament yarns have the disadvantage that, because of their smooth outer surface, they do not hold very well in a seam and can easily be pulled out. When the seam is broken at one point, very frequently a very long length of the sewing thread can be pulled out. For this reason, when a better quality is required, sewing threads are used that consist of staple fibers. However, sewing threads of this type consisting of staple fibers are very expensive to manufacture.

The invention is based on the objective of providing a two-component yarn that can be used as a sewing thread.

This objective is achieved by forming the fiber component of a drawn sliver that is prestrengthened by pneumatic false-twist spinning and twisting it together with the filament yarn.

In the case of this type of two-component yarn, the filament yarn component causes the resistance to tearing, while the fiber component provides a textile quality to this filament yarn. As a result, it becomes usable as a sewing thread even in the case of higher demands, because the fibers cause the two-component yarn to be better anchored in a woven or knitted fabric or the like. However, the two-component yarn according to the invention can be used not only as a sewing thread. It can also be used for particularly tear-resistant popelin fabrics, for shirt fabrics or for bed sheets.

In a further development of the invention, a process is provided for the manufacturing of the two-component yarn from the fiber component and a filament yarn in which, by means of a drawing in a drafting frame and by means of a pneumatic false-twist spinning, a prestrengthened fiber component is produced from a sliver and is combined and twisted together with the filament yarn. Since the fiber component, by means of the pneumatic false-twist spinning, is only prestrengthened, very high production speeds are possible. The prestrengthening of the fiber component must take place to only such an extent that the prestrengthened fiber component can be handled and twisted. Since this already results in a combination with the filament yarn, the demands on the stability of the fiber component may become relatively low. After the twisting-together, the resistance to tearing is determined by the filament yarn.

In order to utilize the advantages of a high production speed as completely as possible, it is provided in a further development of the invention that the prestrengthened fiber component is guided together with the filament yarn and, before the twisting, is intermediately stored on a spool. As a result, the producing of the spool from the multiple-wound yarn component can be implemented at a high production speed. Since, during the twisting of the two yarn components, no spinning twist has to be undone, the twisting may also be carried out at a relatively high working speed.

In a further development of the invention, it is provided that the two-component yarn, after the twisting, is cleaned out by rewinding. This is particularly advantageous if the two-component yarn according to the invention is to be used as a sewing thread.

Other characteristics and advantages of the invention are contained in the following description of the arrangement shown in the drawing. The drawing shows an arrangement by means of which a spool is produced from a two-component yarn, a staple fiber component and a filament yarn, in this case, being cross-wound into a cross-wound spool.

Other objects, advantages and novel features of the present invention will become apparent from the following detailed description of the invention when considered in conjunction with the accompanying drawing.

BRIEF DESCRIPTION OF THE DRAWING

The single drawing figure schematically depicts a yarn spinning arrangement constructed in accordance with a preferred embodiment of the invention.

DETAILED DESCRIPTION OF THE DRAWING

The arrangement shown in the drawing contains a drafting frame 1 to which a staple sliver 2 is fed in the direction of the Arrow (A). In the drafting frame 1, the staple sliver 2 is drawn to the desired size. The drafting frame has bottom rollers 3, 4, 5 that pass through a machine which has several work positions arranged next to one another. The bottom cylinders 3, 4, 5 are driven at one end of the machine. At each work position, pressure rollers 6, 7 and 8 are assigned to the bottom cylinders in a known way. In the main drafting zone, apron guides are conventionally provided of which the top apron 9 is visible.

After the drafting frame 1, the drawn sliver 2 reaches a false-twisting zone 10 in which a pneumatic false-twist spinning is carried out. The false twisting zone 10 contains two air nozzles 11, 12 arranged behind one another in moving direction (A) that are connected to compressed-air pipes 13, 14. The air nozzle 11 is normally constructed essentially as an intake nozzle that does not yet provide any false twist to the drawn sliver 2 or provides only a slight false twist to it. In the air nozzle 12, an air whirl is generated that provides the drawn sliver 2 with a false twist. Behind the air nozzle 12, this false twist opens up again, in which case, however, edge fibers remain wound around the sliver 2 so that a prestrengthened yarn component 15 is obtained. This prestrengthened yarn component 15 consists of an essentially untwisted sliver core, around which the ends of several spread-away fibers are wound. The prestrengthened yarn component 15 has a relatively low strength that is not high enough for this yarn component 15 to be usable as an individual yarn by itself.

The prestrengthened yarn component 15 is withdrawn by means of a withdrawal device 21 that comprises a driven bottom cylinder 22 extending through in the longitudinal direction of the machine and of a pressure roller 23. Before the yarn component 15 moves into the withdrawal device 21, another yarn component consisting of a filament yarn 16 is added to it, so that these two enter the withdrawal device 21 as a double yarn 20. The filament yarn 16, which may be a multifilament or a monofilament, from a spool or the like, is fed in the direction of the Arrow (B), to a delivery device 17 that is formed by the bottom cylinder 5 of the drafting frame and a pressure roller. In the area of the false-twisting zone 10, the filament yarn 16 is deflected by means of two guiding elements 18, 19, to the pre-strengthened fiber component 15 that is moving through in a straight line.

The double yarn 20 formed by the filament yarn 16 and by the yarn component 15 consisting of a pre-strengthened sliver, after the withdrawal device 21, is fed to a wind-up device 24 that contains a driven shaft 25 extending through in the longitudinal direction of the machine by means of which the cross-wound spool 26 is driven. The spool frame of the cross-wound spool 26 as well as a cross-winding device and other details of the wind-up device are not shown.

The cross-wound spool 26 is used as a feed spool for a subsequent twisting during which the two-component yarn is finished. The cross-wound spool may be fed to a ring twisting frame or to a double twisting frame. Particularly, when extremely high demands are made on the two-component yarn with respect to uniformity, the two-component yarn, after the twisting, is rewound once more and is cleaned out in the process, so that yarn defects, such as thick or thin points, are cleaned out and are replaced by another yarn connection, particularly by a splice. In this case, it is possible to combine the twisting machine, the arrangement shown in the drawing and the wind-up machine into a compound machine or, as a composite system, into a machine system.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A two-component yarn comprising:

a pre-strengthened staple fiber component formed by drafted silver which is pre-strengthened by pneumatic false-twist spinning, and a filament yarn component which is twisted together with the previously formed pre-strengthened staple fiber component.

2. A process for producing a two-component yarn consisting of a fiber component and a filament yarn, wherein, by means of a drawing in a drafting frame and pneumatic false-twist spinning, a prestrengthened fiber component is created from a sliver, this prestrengthened fiber component being subsequently combined and twisted together with the filament yarn.

3. A process according to claim 2, wherein the pre-strengthened fiber component is guided together with the filament yarn and, before the twisting, is intermediately stored on a spool.

4. A process according to claim 2, wherein the two-component yarn, after the twisting, is cleaned out by means of rewinding.

5. A process according to claim 3, wherein the two-component yarn, after the twisting, is cleaned out by means of rewinding.

6. A two-component yarn according to claim 1, wherein said components are twisted together to form yarn of sufficient strength to form sewing thread.

* * * * *